United States Patent [19]

Duncan et al.

[11] Patent Number: 4,458,870

[45] Date of Patent: Jul. 10, 1984

[54] ADJUSTABLE SUPPORT ATTACHMENT FOR WHEELCHAIRS

[76] Inventors: Leroy R. Duncan, 5738 W. Canyon Ave.; John E. Chedester, 7791 S. Depew St., both of Littleton, Colo. 80123

[21] Appl. No.: 255,186

[22] Filed: Apr. 17, 1981

[51] Int. Cl.[3] ..... E04G 3/00

[52] U.S. Cl. ..... 248/279; 248/122

[58] Field of Search ..... 248/278, 104, 106, 276, 248/279, 282, 283, 122, 285, 662, 280.1, 274; 297/DIG. 4

[56] References Cited

U.S. PATENT DOCUMENTS

| | | | |
|---|---|---|---|
| 1,059,856 | 4/1913 | Fox | 248/283 X |
| 1,275,311 | 8/1918 | Schumacher et al. | 248/279 |
| 1,714,003 | 5/1929 | Deach | 248/279 |
| 2,019,789 | 11/1935 | Mahannah | 248/279 X |
| 2,524,138 | 10/1950 | Raley | 248/278 X |
| 3,170,665 | 2/1965 | Ryan | 248/311.2 |
| 3,215,467 | 11/1965 | McFarland et al. | 297/162 X |
| 3,480,304 | 11/1969 | Mehr | 248/276 X |
| 3,522,887 | 8/1970 | Petersen | 211/14 |
| 3,730,589 | 5/1973 | Lane | 297/194 X |
| 3,759,569 | 9/1973 | Bennet | 297/DIG. 4 X |
| 3,870,362 | 3/1975 | Large | 297/155 |
| 4,158,428 | 6/1979 | Bates | 297/148 X |

*Primary Examiner*—J. Franklin Foss
*Attorney, Agent, or Firm*—Louis G. Puls, Jr.

[57] ABSTRACT

The present invention is an adjustable support attachment for wheelchairs having vertical or horizontal arm rest members. The support, which is intended to position articles and devices within variable and convenient access to the occupant of the chair, is attached to the arm rest member by means of a mounting base, to which one end of a base tube is releasably and rotatably swivel-mounted. On the other end of the base tube is fixed an adjustable friction joint allowing angular positioning of a lower arm tube in a vertical plane. An adjustable pivoting friction joint on the radially outer end of the lower arm tube allows fully circular positioning throughout a plane perpendicular to the lower arm, in combination with an adjustable friction joint, integral with the pivotal joint, which allows angular positioning of an upper arm member within the rotatable plane including the lower arm. A releasably telescoping rod allows extension of the upper arm in discrete adjustments and an adjustable friction joint fixed at the radially outer end of the rod allows angular tilting positioning of a mounting head within the rotatable plane including the upper arm. The mounting head includes a facing plate perpendicular to the longitudinal axis of the head and a threaded mounting stud perpendicular to the plate.

1 Claim, 3 Drawing Figures

ADJUSTABLE SUPPORT ATTACHMENT FOR WHEELCHAIRS

BACKGROUND OF THE INVENTION

The present invention relates to article support attachments for wheelchairs and in particular to a support which can be readily adjusted throughout the proximity of the occupant.

Numerous attachments have been developed which aid the person in a wheelchair. Among these are devices which attach to the arm rest or frame member tubing, such as trays, receptacles, and supports. The trays are generally at arm rest level, such as in U.S. Pat. No. 3,215,467, entitled Retractable Attachment For Chair Arms, issued to W. McFarland et al. on Nov. 2, 1965, and as in U.S. Pat. No. 3,870,362, entitled Tray Attachment For Wheelchairs, issued to Richard L. Large on Mar. 11, 1975, and as in U.S. Pat. No. 3,522,887, entitled Support For a Paraplegic Wheel Chair, issued to Edward A. Petersen on Aug. 4, 1970. These trays are fixed in vertical and angular position and are not intended to provide fastening support to articles. The receptacles are also generally at arm rest level, and are of limited adjustability, such as in U.S. Pat. No. 3,759,569, entitled Receptacle Attachment For Wheelchair Arm, issued to Lester H. Bennet on Sept. 18, 1973, and as in U.S. Pat. No. 4,158,428, entitled Drop On Lift Off Basket Assembly For a Wheelchair, issued to Clarence W. Bates on June 19, 1979. These receptacles are essentially fixed in vertical, horizontal, and angular position and provide passive enclosure rather than fastening support to articles. Other supports are more adjustable but of a single or specialized application, such as in U.S. Pat. No. 3,170,665, entitled Easy Drinker Device, issued to Mary G. S. Ryan on Feb. 23, 1965, and as in U.S. Pat. No. 3,730,589, entitled Head or Back Support For Wheelchair, issued to Buddy F. Lane on May 1, 1973. These supports are adjustable in several directions but are intended to provide a particular support function rather than a generalized mounting for various articles. None of these patents describe or anticipate a wheelchair attachment which is fully adjustable in vertical, horizontal, and angular directions throughout the arm length proximity of the occupant and which provides fastening support to light and medium weight articles of different types.

The need for an adjustable generalized fastening support attachment exists because many persons in wheelchairs have sufficient use of their arms and hands to manipulate articles or operate devices within reach, and to adjust an easily positioned support of such articles or devices.

SUMMARY OF THE INVENTION

An adjustable support attachment for wheelchairs constructed according to the present invention comprises a mounting base attached to the wheelchair, a base tube releasably and rotatably swivel-mounted thereon which is fixed to an adjustable friction joint allowing the angular positioning of a lower arm tube in a vertical plane, an adjustable pivoting friction joint on the radially outer end of the lower arm tube allowing fully circular positioning throughout a plane perpendicular to said lower arm, in combination with an adjustable friction joint, integral with the pivotal joint, which allows angular positioning of an upper arm member within the rotatable plane including said lower arm, a releasably telescoping rod allowing extension of the upper arm in discrete adjustments, an adjustable friction joint fixed at the radially outer end of said rod allowing angular tilting positioning of a mounting head within the rotatable plane including said upper arm, said mounting head including a facing plate perpendicular to the longitudinal axis of the head and a threaded mounting stud perpendicular to said plate.

A general object of the present invention is to provide a wheelchair support accessory which mounts readily on standard design wheelchairs, enables the occupant with limited manual ability to position, adjust, and secure the support virtually throughout the space within his manual proximity, and allows the occupant to fasten thereon and operate, manipulate, or otherwise use various articles and devices which have been equipped with standard threaded stud fittings.

A specific object of the present invention is to provide a wheelchair support accessory which is adjustable about its fixed base rotationally, vertically up or down, horizontally in all lateral directions, and angularly throughout nearly all solid angle directions by means of lever-advantaged forces and friction joints.

A further specific object of the present invention is to provide a wheelchair support accessory which allows adjustment near the mounting head comprising longitudinal extension and contraction by means of a leveraged pin-lock, angular tilting of the mounting head, and interchanging various threaded stud fastening means.

A major advantage of the present invention over the prior art is that it allows the person in a wheelchair to use many articles not otherwise accessible to him without the air of an attendant or without specially designed or improvised supports which are particular to each type of article.

A further advantage of the present invention over the prior art is that, due to its highly generalized positioning characteristics, it can be readily collapsed into a compact form when not in use and either stored temporarily on the outside of the chair arm rest without interfering with the normal use of the wheelchair, or it may be easily removed from the base mount for separate storage.

Objects and advantages other than those set forth above will be apparent from the following description when read in connection with the accompanying drawings of a preferred embodiment, whose novel features are set forth with particularity in the appended claims.

DESCRIPTION OF THE PREFERRED EMBODIMENT

Figure 1:
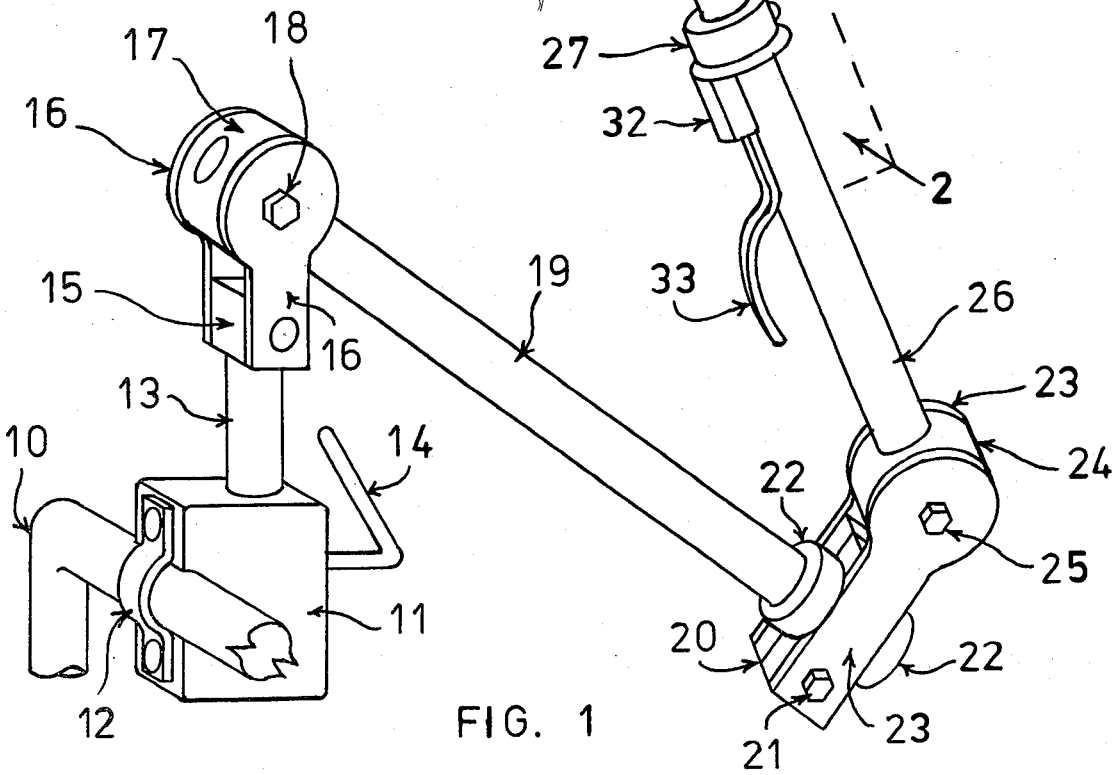
FIG. 1 is a perspective view of the support as attached to a wheelchair arm rest.

Referring to the drawing, like reference numerals in the figures designate like parts. In FIG. 1 reference numeral 10 designates a portion of a conventional wheelchair arm rest, comprising of metal tubular stock. The embodiment of the present invention which has been illustrated is mounted on the horizontal portion of the arm rest, although alternatively a vertical portion could be used, or also some other convenient side frame member of the wheelchair, by suitble orientation of the members of the present support.

Mounted on said arm rest 10 by means of a clamping strap 12 is a mounting base 11 shaped to enclose partially the arm rest 10 opposite said strap 12 fastened by releasable means such as machine screws. The base 11 receives a base swivel tube 13 such that said tube 13 turns readily about its longitudinal axis until releasably fixed by means of the long-handled set screw 14. The components including said base 11, tube 13, and screw 14 comprise a base swivel joint.

Said base tube 13 extends vertically upwardly and is received and fixably fastened, as by nut and bolt, to a rectangular coupling block 15 to which is also fixably fastened parallel and opposing identical lower arm friction plates 16 which extend vertically upwardly and terminate in a generally circular coaxial configuration perpendicular to the axis of the base tube 13. Positioned in contact between and coaxial with said friction plates 16 is a circularly cylindrical lower arm friction disc 17 which rotates readily about its axis until releasably fixed by compressional friction between its circular faces and those of the friction plates 16 by means of a lower arm friction adjustment fastener 18, such as a nut and bolt, along the common axis of the disc 17 and plates 16. The disc 17 receives and is fixably fastened to a lower arm tube 19 positioned perpendicularly to and extending radially outwardly from said common axis. The components including said tube 13, block 15, plates 16, disc 17, tube 19 and fastener 18 comprise a lower arm friction joint.

The radially outermost end of the lower arm tube 19 is received by and releasably and frictionally fastened to a rectangular pivot friction block 20, which is segmented in halves along a plane through the axis of the lower arm tube 19 in such a manner as to provide clamping means on tube 19 using tightening adjustment of a pivot friction fastener 21, such as a nut and bolt, positioned perpendicular to and offset from the axis of the lower arm tube 19. Retention collars 22, fixably fastened on the lower arm tube 19 in rotating contact with either side of said block 20, prevent longitudinal movement and provide further pivotal friction.

Fixed to said block 20, by suitable fastening means such as machine screws, are a pair of parallel and opposing identical upper arm friction plates 23, positioned perpendicular to the axis of the lower arm tube 19 and parallel to said plane segmenting block 20. Similarly to plates 16, the upper arm friction plates 23 terminate in a generally circular coaxial congifuration in facing contact with and enclosing a circularly cylindrical upper arm friction disc 24, which rotates readily about its axis until releasably fixed by compressional friction between its circular faces and those of the friction plates 23 by means of an upper arm friction adjustment fastener 25, such as a nut and bolt, along the common axis of the disc 24 and plates 23. The disc 24 receives and is fixably fastened to an upper arm tube 26 positioned perpendicularly to and extending radially outwardly from said common axis. The components including said tube 19, block 20, fastener 21, collars 22, plates 23, disc 24, fastener 25, and tube 26 comprise an upper arm friction joint.

Figure 2:
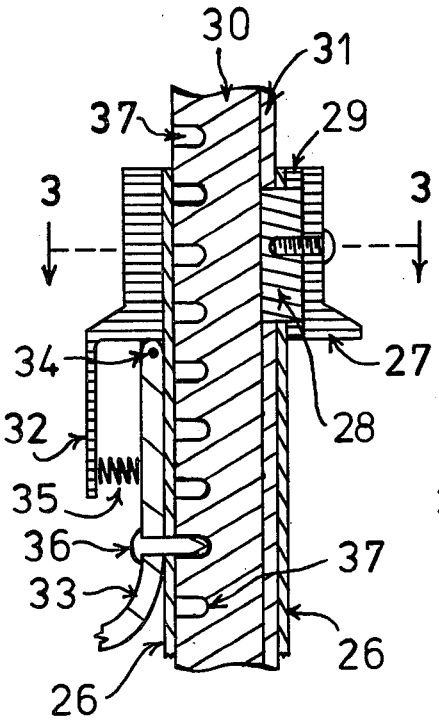
FIG. 2 is a cross-sectional view taken along the plane 2—2 in FIG. 1.
Figure 3:
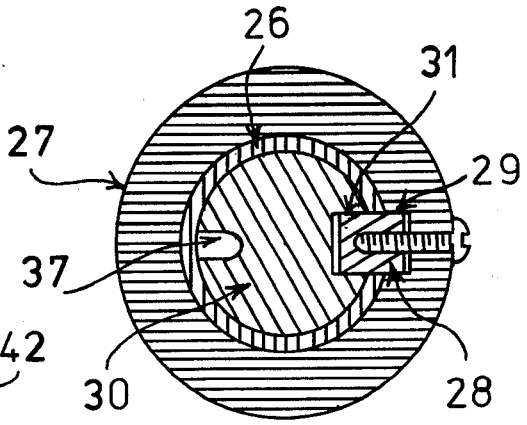
FIG. 3 is a cross-sectional view taken along the plane 3—3 in FIG. 2.

The radially outermost end of the upper arm tube 26 is received by and fixably fastened to a coupling collar 27. Referring to FIG. 2 and FIG. 3, said tube 26 receives parallel to its axis a key 28 which is fastened, as by a machine screw, to the coupling collar 27 within a collar keyway slot 29. An extension arm rod 30 is slidably and telescopingly received internally by said tube 26 such that a portion of key 28 internal to tube 26 is slidably received within a rod keyway slot 31 parallel to the axis of and extending along the length of said rod 30. Said keyway slot extends near but not through the ends of said rod 30, providing a limit stop to the sliding motion of said rod 30.

Integral with coupling collar 27 and extending along said tube 26 is a lever housing 32 to which is rotatably fastened an extension arm release lever 33 by means of a lever fulcrum pin 34. An engaging spring 35 between said housing 32 and release lever 33 retains locking pin 36 in receiving position through tube 26 into one of a plurality of locking holes 37 in and distributed along the length of said rod 30. The components including said tube 26, collar 27, key 28, rod 30, lever 33, pin 34, spring 35, and locking pin 36 comprise an upper arm extension coupling joint.

Referring back to FIG. 1, the end of said rod 30 extending longitudinally away from and external to said tube 26 is received by and fixably fastened to a circularly cylindrical mounting head friction disc 38, such that the axis of said disc 38 is perpendicular to the axis of said rod 30. Said disc 38 is in facing contact with and enclosed by a portion of a pair of parallel and opposing identical mounting head friction plates 39 of generally circular coaxial configuration similar to those of plates 23 and 16, such that plates 39 rotate readily with respect to said disc 38 about their common axis until releasably fixed by compressional friction between their circular faces and those of said disc 38 by means of a mounting head friction adjustment fastener 40, such as a nut and bolt, along said common axis of said disc 38 and plates 39.

Said plates 39 extend radially outward from and perpendicularly to said common axis and form a generally rectangular terminus enclosing and fixably fastened to a generally rectangular mounting head block 41 on which is fixably fastened a generally circular mounting face plate 42 such that the facing plane of said plate 42 is perpendicular to the longitudinal axes of said plates 39 and parallel to the common axis of said disc 38 and the generally circular portions of said plates 39. An outwardly projecting threaded mounting stud bolt 43 is fastened into the center of and perpendicular to said face plate 42. The components including said rod 30, disc 38, plates 39, fastener 40, block 41, face plate 42, and stud 43 comprise a mounting head friction joint.

The tube, plate, rod, block, and collar stock as described heretofore is preferably of aluminum or its alloys except where steel stock is more suitable such as for the base clamping strap 12, base tube 13, lever arm set screw 14, key 28, release lever 33, locking pin 36, and mounting head face plate 42, as well as all fasteners. However, other suitable materials can be substituted within the scope of the present invention.

The adjustable support attachment for wheelchairs as heretofore described provides a mounting for a multiplicity of articles and devices, which have been or are capable of being equipped with standard threaded mountings and couplings, such as cameras, flash and spot lighting equipment; electronic consumer or specialized devices such as tape recorders, radios, microphones, and remote control switches; trays, tables, or holders for books, writing and craft materials, and art works; rifles and other sporting equipment; and various other light or medium weight objects which can be supported by a threaded mount.

To position the mounting face plate 42 and stud 43 in virtually any location within the manually accessible proximity to a wheelchair occupant, the swiveling, pivoting, rotating, and extending degrees of freedom of the present invention are readily manipulated by means of leverage forces. All four friction joints can be tightened in final position by means of a single size wrench when all joint fasteners 18, 21, 25, and 40 are comprised of the same size nut and bolt.

The swivel position of the base tube 13 is easily adjusted and tightened by means of the lever arm set screw 14 to allow horizontal orientation of the lower arm 19 throughout a full circle of arc. The lower arm 19 can be rotated throughout approximately three-quarters of a full circle within any plane through the base tube 13, allowing vertical and angular orientation of the lowermost end of the upper arm 26. The uppermost end of the upper arm 26 can be pivoted throughout a full circle of arc about the axis of the lower arm 19, and can also be rotated throughout approximately a half-circle of arc within any plane defined by the axis of the lower arm 19 and the axis of the upper arm 26.

The upper arm telescoping rod 30 is easily lengthened or shortened in longitudinal extension by means of the long-handled release lever 33. The extension arm keyway slot 31 terminates near but does not pass through the end of said rod 30 internal to the upper arm tube 26, hence precluding an inadvertent separation of said rod 30 and said tube 26 during an extension adjustment. The mounting head face plate 42 can be rotated in final tilting adjustment throughout approximately three-quarters circle of arc within any plane defined by the axis of the lower arm 19 and the axis of the upper arm 26. The stud bolt 43 is preferably a standard quarter inch—twenty threads per inch mounting, which allows direct coupling to articles or devices as well as indirect coupling such as by means of adapters to other thread sizes or fasteners, standard ball-joint mounts, and other suitable brackets or surfaces capable of mounting, holding, or otherwise retaining articles and devices.

When not in use, the present invention can be easily removed either by unfastening the clamping strap 12 and removing the mounting base 11, or by unfastening the lever set screw 14 and decoupling the base tube 13 from the mounting base 11, which can be retained attached to the arm rest 10. The support can be compactly collapsed for storage, whether attached or removed, into a generally parallel configuration of the base tube, lower arm, and upper arm.

While the above description contains many specificities, these should not be construed as limitations on the scope of the invention, but rather as an exemplification of one preferred embodiment thereof. Many other variations are possible, for example different combinations of materials, lengths, thicknesses, and diameters of tubes, rods, discs, and plates, or of alternate friction surfaces and bushings, or of various fasteners such as wing-nuts or otherwise handle-leveraged tighteners. Accordingly, the scope of the invention should be determined not by the embodiment illustrated, but by the appended claims and their legal equivalents.

What is claimed is:

1. In an adjustable support attaching to a wheelchair arm rest or side frame member, for supporting articles adapted for threaded mounting means, and including an adjustable lower arm and an adjustably telescoping upper arm, the improvement which comprises in combination:

(a) an attachment base swivel joint in which is releasably fastened by a lever-advantaged set screw a base swivel tube member;

(b) a lower arm friction joint between the base tube and the lower arm, such that said lower arm is rotatable in a plane defined by said lower arm and said base tube, and is releasably fixable in angular position by use of said lower arm as a lever-advantaged handle;

(c) an upper arm friction joint between the lower arm and the upper arm, such that said upper arm is pivotal about said lower arm, and rotatable in a plane defined by said lower arm and said upper arm, and releasably fixable in both angular positions by use of said upper arm as a lever-advantaged handle;

(d) an extension coupling joint whereby said adjustably telescoping upper arm is incrementally adjusted in length by use of a lever-advantaged release handle;

(e) a mounting head friction joint which is tiltably rotatable and releasably fixable in angular disposition of said threaded mounting means for said supported articles.

* * * * *